US006145156A

United States Patent [19]

Pullara, Jr. et al.

[11] Patent Number: 6,145,156

[45] Date of Patent: Nov. 14, 2000

[54] FOOT MOP

[76] Inventors: Johnny J. Pullara, Jr.; Michael A. Solomon, both of 4221 Empire Pl., Tampa, Fla. 33610

[21] Appl. No.: 09/234,961

[22] Filed: Jan. 21, 1999

[51] Int. Cl.[7] ..... A47L 13/20

[52] U.S. Cl. ..... 15/227; 15/257.01; 220/571

[58] Field of Search ..... 15/227, 228, 209.1, 15/1, 104.94, 257.01, 215, 216, 217, 161; 36/7.1 R, 7.2, 9 R, 15, 100, 113; 206/349, 361, 483, 561; 220/571, 571.1, 572

[56] References Cited

U.S. PATENT DOCUMENTS

| | | | |
|---|---|---|---|
| 2,571,606 | 10/1951 | Peterson . | |
| 2,738,533 | 3/1956 | Peterson . | |
| 2,784,436 | 3/1957 | Peterson . | |
| 3,362,775 | 1/1968 | Muecke . | |
| 3,460,182 | 8/1969 | Grande, Jr. . | |
| 3,528,120 | 9/1970 | Lindstrom . | |
| 3,680,170 | 8/1972 | Sims . | |
| 3,699,672 | 10/1972 | Sims . | |
| 3,920,144 | 11/1975 | Callen | 220/571 |
| 5,168,586 | 12/1992 | Small | 220/571 |
| 5,173,985 | 12/1992 | Palmer . | |
| 5,184,749 | 2/1993 | Attenasio | 15/257.01 |
| 5,473,788 | 12/1995 | Aragona . | |
| 5,613,897 | 3/1997 | Thompson, Jr. . | |
| 5,644,813 | 7/1997 | Puskas . | |

FOREIGN PATENT DOCUMENTS

| | | |
|---|---|---|
| 131554 | 5/1929 | Switzerland . |
| WO 90/05478 | 5/1990 | WIPO . |

*Primary Examiner*—Randall E. Chin
*Attorney, Agent, or Firm*—Kenneth L Tolar

[57] ABSTRACT

A foot mop includes a cover member configured and contoured to receive and overlay a substantial portion of a user's shoe sole. The cover member has an interior surface, an exterior surface and a continuous free edge that defines an opening. On the interior surface of the cover member are a plurality of peripherally disposed snaps adjacent the free edge for matably engaging snaps on an adhesive strip peripherally mounted about the shoe. The exterior surface of the cover member includes a sponge layer with a plurality of mop like fibers mounted thereover for absorbing liquids. The device also includes a wall mounted storage device for draining and collecting fluids adhering to the cover member.

9 Claims, 1 Drawing Sheet

FOOT MOP

BACKGROUND OF THE INVENTION

The present invention relates to a mop-like device removably attachable to a user's shoe sole allowing the user to clean spills without bending over.

DESCRIPTION OF THE PRIOR ART

Minor spills often occur while a user is cooking, preparing meals or eating. Each time such a spill occurs, a user must bend over and wipe the spill with a napkin or towel. The repeated bending is laborious, inconvenient and strenuous. The present invention provides a mop, configured to cover and attach to a user's shoe sole allowing a user to conveniently clean spillage in a standing position.

Various cleaning devices for attaching to a user's shoe exist in the prior art. For example, U.S. Pat. No. 5,644,813 issued to Puskas relates to a disposable overshoe mop including a slip on cover for covering a user's shoe with a cleaning surface on the bottom side thereof. The cleaning surface relates to a compressible, water absorbent material such as a foam rubber pad.

U.S. Pat. No. 5,613,897 issued to Thompson, Jr. relates to a rectangular cleaning pad having a strap attached thereto for mounting the pad to a user's shoe sole.

U.S. Pat. No. 5,473,788 issued to Aragona relates to a foot sponge for cleansing user's feet.

U.S. Pat. No. 5,173,985 issued to Palmer relates to a scrubber device comprising a flat sole plate having an upper portion for receiving a user's toe and a heel strap.

U.S. Pat. No. 3,699,672 issued to Sims relates to a cleaning pad including a strap which may be strapped across a user's foot to secure the device to a user's shoe.

U.S. Pat. No. 3,680,170 issued Sims relates to a floor cleaning device including a cleaning pad having an elastic means for attaching the pad to a user's shoe.

Although shoe or foot attachable cleaning devices exist in the prior art, none relate to a device according to the present invention. The present invention relates to a mop-like device which may be readily snapped to a user's shoe for cleaning minor spills. The snaps allow the mop to be quickly and securely attached to the shoe with minimal effort. Furthermore, unlike any of the foot attachable cleaning devices described above, the present invention is configured similarly to a conventional mop thereby enhancing the cleaning and liquid absorbing qualities thereof.

SUMMARY OF THE INVENTION

The present invention relates to a shoe attachable mop device. The device comprises a cover member dimensioned to overlay and receive the sole portion of a person's shoe. The cover member includes an interior surface, an exterior surface and a continuous free edge. Peripherally attached to the interior surface of the cover member, adjacent the free edge, are a plurality of female snap members. An adhesive strip having a series of male strap members on its exterior surface is peripherally secured about the shoe. Accordingly, the cover member may be quickly attached to a user's shoe by coupling the mating snaps. The exterior surface of the cover member includes a plurality of mop-like fiber members covering at least a portion of a sponge. The device also includes a wall mounted storage tray specifically configured to store and drain the foot mop between uses. It is therefore an object of the present invention to provide a foot mop which may be quickly and conveniently attached to a user's shoe.

It is yet another object of the present invention to provide a foot mop specifically designed to resemble a conventional mop.

It is yet another object of the present invention to provide a foot mop having an accompanying drainage receptacle for storing and drying the mop between uses. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
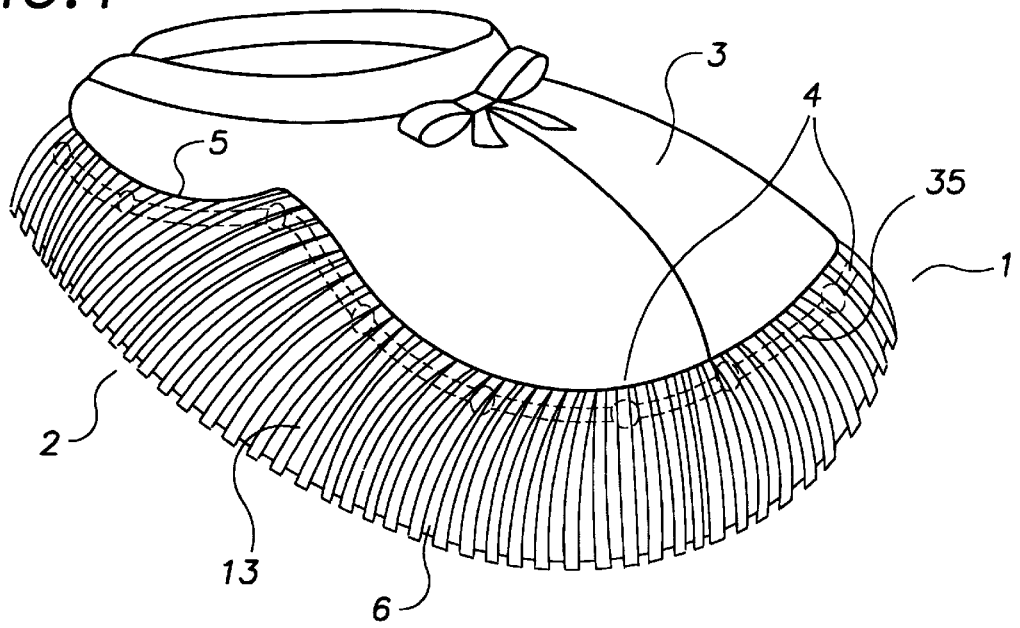
FIG. 1 is a perspective view of the foot mop according to the present invention, attached to a user's shoe.
Figure 2:
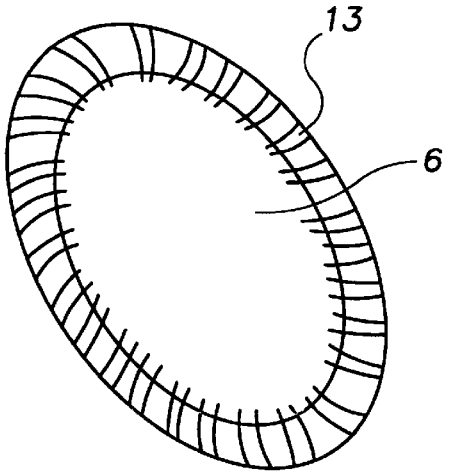
FIG. 2 is a bottom view of the inventive device.

Referring now to FIGS. 1 through 4, the present invention relates to a foot mop referenced generally by numeral 1. The device comprises a cover member 2 generally configured and contoured to receive and completely overlay the sole portion of a user's shoe or slipper 3. The cover member includes an interior surface, an exterior surface and a continuous free edge 5 that defines an opening. Peripherally disposed about the exterior surface of the cover member adjacent the free edge are a plurality of female snap members 4. The female snap members are spaced and positioned to matably engage a plurality of male snap members disposed on a strip 35 adhesively attached about the exterior periphery of the shoe sole. Accordingly, the cover member may be quickly and securely fastened about the shoe sole by individually coupling the mating snap members. As will be readily apparent to those skilled in the art, any other conventional attachment means may also be used.

A portion of the exterior surface of the cover member includes a moisture absorbing layer 6, such as foam, for absorbing liquids. Preferably, the foam layer overlays most or all of the shoe sole when the cover member is fastened to the shoe. Covering at least a portion of the foam layer are a plurality of string like fibers 13 similar to those found on a conventional mop. The fibers increase the device's effectiveness in removing stains and absorbing liquids. Whenever the cover member becomes completely soiled, the cover member may be quickly removed and cleaned.

Figure 3:
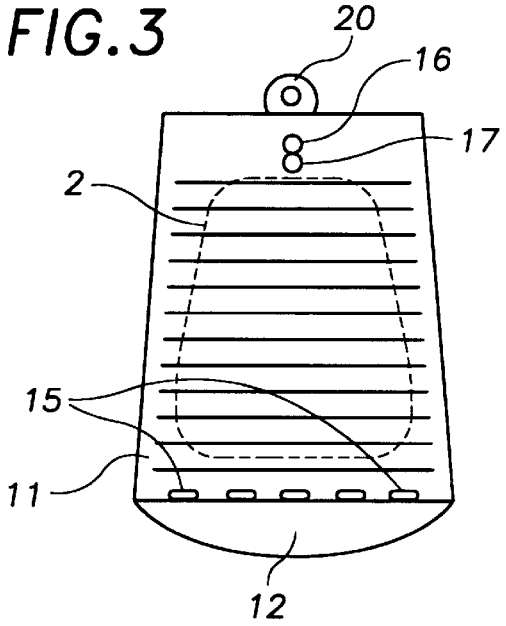
FIG. 3 is a top view of an accompanying storage tray for the foot mop.
Figure 4:
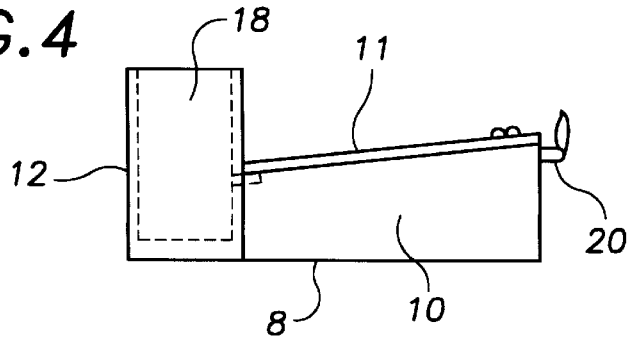
FIG. 4 is a cross-sectional side view of the storage tray.

Now referring to FIGS. 3 and 4, the present invention also includes a storage device 8 for retaining and draining the cover member between uses. The storage device includes a hollow base component having a horizontal portion 10 with a top wall 11 mounted thereon. The top wall is angled downwardly toward a lower edge that is adjacent a vertically oriented compartment 12. The lower edge of the top wall includes a plurality of drain apertures 15 in communication with a storage reservoir 18 disposed within the vertical compartment. On the exterior surface of the top wall is a hook and loop fastener 16 for matably engaging a similar hook and loop fastener 17 on the exterior surface of the cover member. Any other conventional attachment means may also be used. Accordingly, a wet cover member may be attached to the top wall whereby fluid will drain toward the lower end and into the storage reservoir. The reservoir is removable allowing it to be periodically emptied. The horizontal portion of the storage device further includes a mounting means 20 for securing the device to a wall or similar supporting surface.

Preferably, the cover member is constructed with fabric. The storage device may be constructed with any lightweight material such as plastic or a similar equivalent. However, as will be readily apparent to those skilled in the art, the size, shape and materials of construction may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A foot mop comprising:

a cover member configured and contoured to receive and overlay a substantial portion of a user's shoe sole, said cover member including an exterior surface, an interior surface and a free edge that defines an opening for receiving the shoe sole;

a plurality of fastener means peripherally disposed about the interior surface of the cover member and adjacent the free edge;

a strip peripherally disposed about the exterior of a user's shoe, said strip having a plurality of fastener means positioned and spaced to matably engage the fastener means on said cover member whereby said cover member may be quickly attached to said shoe;

a layer of liquid absorbing material on the exterior surface of said cover member.

2. A device according to claim 1 wherein said liquid absorbing layer includes a sponge.

3. A device according to claim 2 further comprising a plurality of fibers overlaying at least a portion of said sponge to enhance the moisture absorbing and stain removing qualities of said foot mop.

4. A device according to claim 1 wherein said fastener means are mating snaps.

5. A device according to claim 1 further comprising a storage means for storing and draining said cover member.

6. A device according to claim 5 wherein said storage means comprises a hollow base component including a substantially horizontal top wall, said top wall angled downwardly toward a lower end, said lower end having a plurality of drain apertures adjacent thereto, said drain apertures in fluid communication with a storage reservoir whereby said cover member may be placed on said top wall so that fluids adhering thereto will drain into said storage reservoir.

7. A device according to claim 6 further comprising means for attaching said base component to a supporting surface.

8. A device according to claim 7 wherein said base component includes a compartment having the storage reservoir removably received therein.

9. A device according to claim 8 wherein the exterior surface of the top wall includes an attachment means for matably engaging an attachment means on the cover member.

* * * * *